US006694645B2

(12) United States Patent
Messmer et al.

(10) Patent No.: US 6,694,645 B2
(45) Date of Patent: Feb. 24, 2004

(54) LACE BINDING FOR A SNOWSHOE

(75) Inventors: Nathan J. Messmer, San Francisco, CA (US); Charles Bentley Warner, San Francisco, CA (US); Deirdre O'Mara, San Francisco, CA (US); Luca Innocente, Crocetta del Montello (IT); Franco Bastasin, Crocetta del Montello (IT); Giancarlo Pozzobon, Crocetta del Montello (IT)

(73) Assignee: Winterquest LLC, Stowe, VT (US)

( * ) Notice: Subject to any disclaimer, the term of this patent is extended or adjusted under 35 U.S.C. 154(b) by 0 days.

(21) Appl. No.: 10/039,167

(22) Filed: Jan. 4, 2002

(65) Prior Publication Data

US 2003/0126765 A1 Jul. 10, 2003

(51) Int. Cl.[7] ..... A43B 5/00
(52) U.S. Cl. ..... 36/122; 36/124; 36/125
(58) Field of Search ..... 36/122, 123, 124, 36/125

(56) References Cited

U.S. PATENT DOCUMENTS 3,596,374 A * 8/1971 Covington ..... 36/125
3,599,352 A * 8/1971 Novak et al. ..... 36/123
3,755,926 A * 9/1973 Schonbrun ..... 36/125
3,885,327 A * 5/1975 Maki ..... 36/125
4,271,609 A * 6/1981 Merrifield ..... 36/125
5,517,772 A * 5/1996 Anderson ..... 36/122
5,542,197 A * 8/1996 Vincent ..... 36/122
5,659,981 A * 8/1997 Liautaud ..... 36/122
5,836,093 A * 11/1998 Gallay ..... 36/125
6,056,300 A * 5/2000 Carpenter et al. ..... 280/14.22

* cited by examiner

*Primary Examiner*—M. D. Patterson
(74) *Attorney, Agent, or Firm*—Thomas M. Freiburger

(57) ABSTRACT

A binding for a snowshoe has a base secured to a footbed connected to the snowshoe frame, and a tongue piece above the footbed, connected at front to the footbed in a flexible hinge and positioned to engage the top of a user's boot, from the toe to the arch. At each side of the binding, between the tongue piece and the footpad, lacing extends in zig-zag configuration from the front to the back of the binding, passing through lacing eyes and slidable through the eyes with relatively low friction, for drawing the tongue piece down onto the boot. At the back of the binding, a heel strap is positioned to extend around the heel of the foot, and this heel strap is connected to the lacing at both sides, such that when the heel strap is tightened via slip-through type adjustment buckles, this pulls on the lacing to tighten the lacing at both sides and snug the tongue piece down against the boot, firmly engaging the boot in the binding. The left and right buckles can be attached to loops in the lacing to double the rate of drawing the lacing as compared to movement of the buckles. In one embodiment the binding has a laterally oriented connecting bracket at bottom for connection to a suspension strap on a snowshoe, as this bracket has a bias tilt angle such that the pitch of the binding and boot will be biased toe-down about 10° to 25°.

9 Claims, 1 Drawing Sheet

LACE BINDING FOR A SNOWSHOE

BACKGROUND OF THE INVENTION

This invention concerns snowshoes, and specifically an improved binding or harness for firmly engaging the user's boot, and providing for adjustment and tightening of the binding on the boot in a convenient manner.

Snowshoe bindings have taken a number of different forms. See, for example, Atlas Snowshoe Company U.S. Pat. Nos. 5,687,491 and 5,918,387. Those patents show strap bindings where the straps pass through adjustment buckles, requiring tensioning of the straps over the shoe, and sometimes also the joining of a buckle connection, as well as the engagement of a heel strap.

The straps described above have often been employed along with some form of harness shell capable of engaging around the shoe and with sufficient flexibility to generally conform to the shoe. Again, see Atlas U.S. Pat. No. 5,918,387. Such a shell was effective on some snowshoes to minimize direct contact between the straps and the shoe.

SUMMARY OF THE INVENTION

A binding for a snowshoe of the invention has a base secured to a footbed connected to the snowshoe frame, and a tongue piece above the footbed, connected at front to the footbed and positioned to engage the top of a user's boot, from the toe to the arch. At each side of the binding, between the tongue piece and the footpad, lacing extends in zig-zag configuration from the front to the back of the binding, passing through lacing eyes and slidable through the eyes with relatively low friction, for drawing the tongue piece down onto the boot. At the back of the binding, a heel strap is positioned to extend around the heel of the foot, and this heel strap is connected to the lacing at both sides, such that when the heel strap is tightened via slide-through type adjustment buckles, this pulls on the lacing to tighten the lacing at both sides and snug the tongue piece down against the boot, firmly engaging the boot in the binding. The left and right buckles can be attached to loops in the lacing to double the rate of drawing the lacing as compared to movement of the buckles.

A lace binding for a snowshoe in one embodiment of the invention includes a footbed connected to a snowshoe, and a tongue piece configured to fit over and generally conform to the top of a user's shoe, from toe to arch. The tongue piece is connected in a flexible hinge connection at a front of the tongue piece to the footbed. At left and right sides of the tongue piece are a series of lace eyes, arranged serially from front to back along each side, and a corresponding series of lace eyes are connected to the footbed. Lacing is included at each side of the binding, passing through lace eyes of the tongue piece and lace eyes connected to the footbed, generally in alternating relationship, and being connected to the tongue piece and footbed such that when the laces are pulled rearward at the back of the binding, at left and right sides, the laces will draw the tongue piece down toward the footbed, firmly engaging the top of the user's boot.

In a preferred embodiment, as noted above, a heel strap is connected to the lacing at both sides, such that tightening of the heel strap simultaneously tightens down the tongue piece.

It is thus an object of the invention to improve over prior snowshoe bindings, in convenience of use, stability and reliability. These and other objects, advantages and features of the invention will be apparent from the following description of a preferred embodiment, considered along with the accompanying drawings.

DESCRIPTION OF PREFERRED EMBODIMENTS

Figure 1:
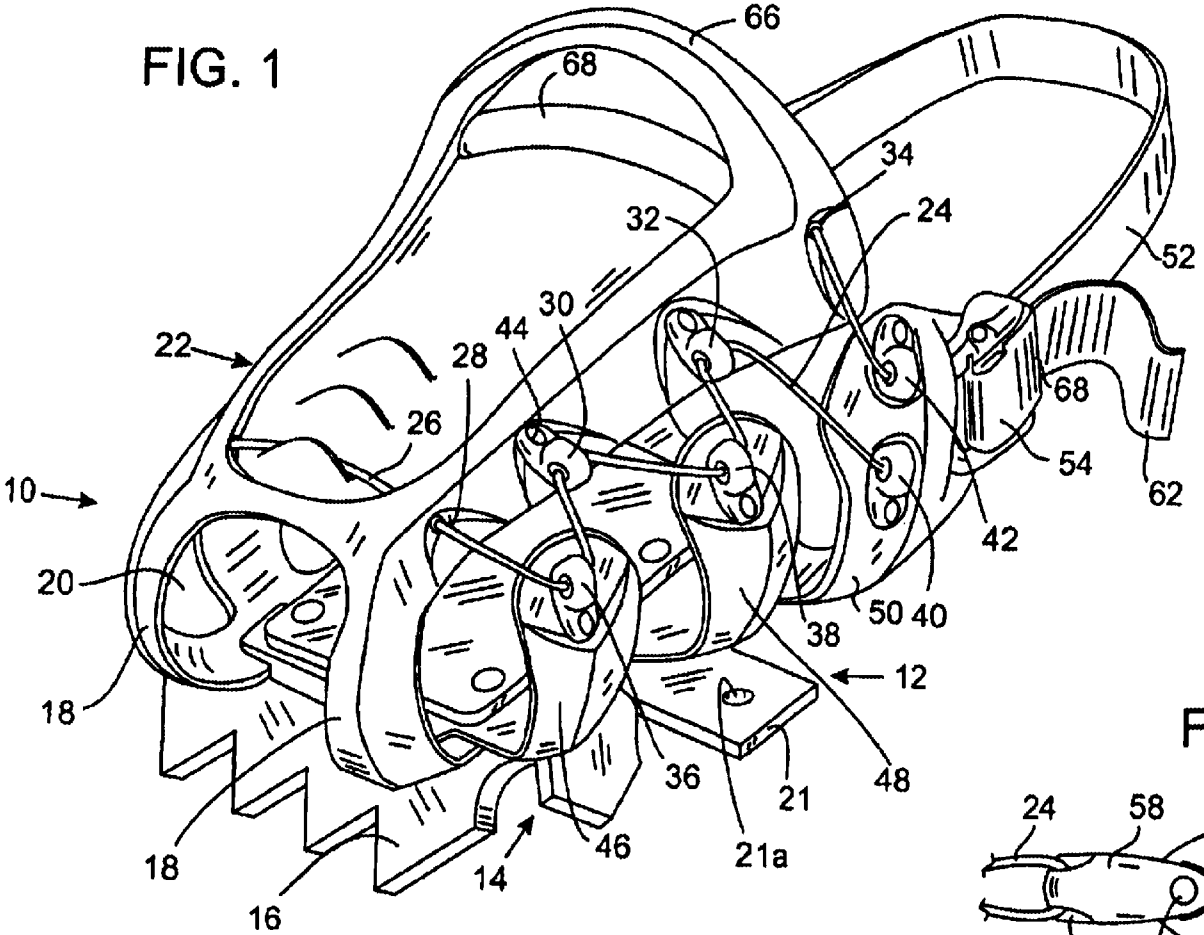
FIG. 1 is a perspective view showing a snowshoe binding according to the invention, the remainder of the snowshoe being omitted.

In the drawings, FIG. 1 shows a snowshoe binding 10 according to the invention, with a footbed 12 comprised of a metal front claw 14 secured to a footpad 16 above. The footbed 12 has secured to it an elastomeric hinge connection 18, shown here as a pair of separate legs 18 with an opening 20 between them. These hinge legs 18 are integral with a tongue piece 22, which is configured to engage against the top of the user's boot, generally over the toe and arch areas, and preferably contoured to generally fit against the boot. The material of the tongue piece and of the integral hinge elements 18 may be molded urethane, preferably a fairly stiff but still flexible urethane.

FIG. 1 shows that the metal front claw 14 includes an integral connection platform 21 for connecting the binding to a transverse suspending strap on a snowshoe. To enable the binding to be used with a single suspending strap between the rails of the snowshoe (as contrasted with a two-strap suspension system as in Atlas Snowshoe Company U.S. Pat. Nos. 5,440,827 and 5,687,491, for example), the connection platform or bracket 21 is angled. A binding connection with a single-strap suspension from a frame is shown, for example in Atlas U.S. Pat. No. 5,918,387, which is incorporated herein by reference. The platform 21 is angled downwardly from front to back at an oblique angle to the remainder of the footbed, i.e. to the approximate plane of the bottom of the user's shoe or boot. The angle can be in the range of about 10° to 25°; one preferred angle is about 15°. When the bracket or platform 21 is secured to a suspension strap on the snowshoe, which can be via a plurality of fastening holes 21*a*, this puts a built-in pitch bias to the angle of the user's boot as compared to the snowshoe frame. The front of the binding is biased downwardly relative to the snowshoe, for reasons discussed in several of the above listed patents. In addition, the connecting bracket or platform 21 is relatively wide, e.g. at least about 4½" wide in one embodiment, preferably about 5" wide, with about 4½" between fastener holes 21*a*, or at least about 3" between holes. This increases stability of the snowshoe on the user's foot, particularly on sidehill terrain, while still allowing some flexibility of the binding to rotate in the roll direction (about a generally forward-back horizontal axis) when the snowshoe is used in sidehill terrain.

The described bias-angled connection bracket or platform 21 is an important feature of a snowshoe binding, for connection to a single suspension strap of a snowshoe, whether or not the particular binding harness described herein is employed. It can be used with other harnesses, such as those of the patents referenced above The tongue piece 22 is drawn down toward the footbed by lacing 24 as shown. The lacing 24 can comprise two laces, one at left and one at right, or one continuous lace 24 as shown, continuous across a frontal area 26 of the binding where it can in be set at a plurality of take-up settings, here shown as three: large, medium, and small. The central portion of the lace 26 is embedded under a locking tab marked "L" in the configuration shown, or, for smaller boot sizes the lace can be pulled up and embedded under the tab marked "M" or the tab marked "S", thereby taking more of the lacing out of service and providing for drawing the tongue piece closer down toward the footbed 14 when the boot is secured to the snowshoe.

As shown, the lacing 24 passes through lace eyes 28, 30, 32, and 34 on the side of the tongue piece, both sides preferably being similar (but not necessarily identical). The lacing generally alternates from these eyes to lace eyes connected to the footbed, i.e. the lace eyes 36, 38, 40 and 42 shown in the drawing, except that in the embodiment shown the lace eye 42 is an exception to the alternating relationship. The lace eyes 30, 32, 36, 38, 40 and 42 can comprise substantially rigid molded plastic members forming low-friction eye holes, each secured by fasteners such as rivets 44. At the lower side, these lace eyes 36, 38, 40, and 42 are connected to the footbed via tabs 46, 48, and 50 that preferably are integral extensions of the footpad. These are somewhat contoured pieces with a degree of flexibility sufficient to allow them to be drawn against the boot when the lacing is drawn tight. Thus, these tabs may also be formed of molded urethane material. The urethane retains its properties closely even under very low temperature conditions.

Although the footbed and the tongue piece with its front hinge member 18 may be one integral urethane molding, it is preferable that they are separate. This enables the footbed to be formed of a material which is somewhat more flexible and softer than the tongue piece/hinge. It also enables variable assembly for different boot sizes. The front hinge connector legs 18, preferably assembled underneath the footpad 16, between the metal claw platform 14 and the footpad 16, can be assembled in a forward position or a rearward position depending on boot size to be accommodated. A small shift in this position of assembly can make a difference of several boot sizes.

Figure 2:
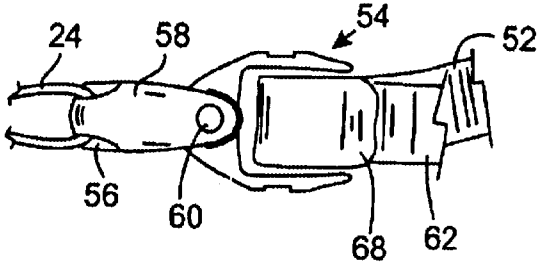
FIG. 2 is a side view showing a cam lock buckle and its connection to other components of the binding.

FIGS. 1 and 2 show that a heel strap 52 extends back generally horizontally in generally a U configuration, to engage around the back of a user's boot. The strap 52 is engaged with at least one buckle 54, a buckle of the slip-through adjustable locking type shown, and this may be a cam lock buckle such as shown in co-pending application Ser. No. 09/494,324 assigned to the assignee of the present invention. Such a cam lock buckle bites more tightly into the strap, holding the strap more firmly, as more tension is placed on the working part 52 of the strap. Preferably two such buckles are employed, one at left and one at right at the rear of the binding 10. They are connected to the remainder of the binding preferably as shown in FIG. 2, in such a way as to pull on the lacing 24 when the heel strap is tightened around the boot. A direct connection from the buckle 54 to an end of the lace 24 could be used, so that tightening movement of the strap 52 would cause a 1:1 drawing movement on the lacing 24 as compared to buckle movement, but in this preferred embodiment the buckles are connected to the lacing 24 by a slip connection 56, the connection 56 being a slide opening in a linkage member 58 which is preferably connected by pivot 60 to the buckle 54. This doubles the rate of drawing of the lacing 24 as compared to the movement of the buckle 54, i.e., a 2:1 relationship, while providing that the rate of drawing of the lacing 24 will equal the rate of drawing back of the strap tail 62 as a user tightens the heel strap.

It is preferred that two buckles 54 be provided, one on each side, because of the length of strap tail 62 which would be required if only one were provided, and because of the friction at the back of the boot. Such friction makes difficult the drawing of the strap around the boot heel to pull the lacing of the opposite side (the side not seen in FIG. 1), thus making likely an imbalance in the tightening of the lacing at the two sides.

The tongue piece preferably includes an integrally molded loop 66 extending upwardly as a handle for the user to open the space between the tongue piece and the footbed for inserting the shoe, and also for removing the shoe.

When the shoe or boot is to be removed from the snowshoe, the user simply releases the cam lock buckle 54 by pulling outwardly on the buckle lever 68. Releasing only one side can be effective to loosen the lacing on both sides, as well as the heel strap itself, but it is preferable to release both sides.

The tab 50 at the back left of the binding 10 finds a counterpart on the opposite side (not shown), and that counterpart tab is at the inner side of the foot, located at the concave arch of the boot and foot. The counterpart tab is shorter in length than the tab 50, to cause the counterpart tab to be drawn more tightly, thus firmly engaging the concave arch of the user's foot and boot, at the bottom and up the side. This adds stability and tends to prevent rotation of the shoe in the binding, about a vertical (yaw)axis.

In a preferred embodiment the tongue piece 22 has a softer padding 68 at its underside. This is shown extending back beyond the edge of the tongue piece in FIG. 1, generally below the handle 66, and it extends under the entire tongue piece. This provides a softer entry for the boot and a more flexible, soft and countered engagement against the boot when the binding is tightened. The foam padding may comprise EVA foam.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A lace binding for a snowshoe, comprising:

a footbed adapted to be connected to a snowshoe, a tongue piece spaced above the footbed and configured to fit over and generally conform to the top of a user's shoe or boot, generally from toe to arch, the tongue piece having a front end connected in a flexible hinge connection to the footbed, a series of lace eyes at left and right sides of the tongue piece and arranged serially from front to back along each side, and a corresponding series of lace eyes connected to the footbed, a lace at each side of the binding, passing through lace eyes of the tongue piece and lace eyes connected to the footbed generally in alternating relationship, and being connected to the tongue piece and footbed such that when the laces are pulled rearwardly at the back of the binding, at left and right sides, the laces will draw the tounge piece down toward the footbed, firmly engaging the top of the user's boot, a heel strap positioned to extend generally horizontally around the back of the user's boot in a U configuration, with a slip-through locking buckle at left and right sides at the rear of the binding, and the buckles being connected to the lacing at left and right at the rear of the binding, such that when the heel strap is pulled tight at left and right via the slip-through locking buckles, this is effective to pull the lacing back at both sides, simultaneously drawing the tongue piece down into firm engagement with the boot, and wherein the buckles are connected to the lacing by a loop-through connection, the lace at each of left and right sides at the rear of the binding having an end fixed to the tongue piece, thereby providing 2:1 lace drawing movement as compared to movement of the buckles.

2. A lace binding for a snowshoe, comprising:

a footbed adapted to be connected to a snowshoe, a tongue piece spaced above the footbed and configured to fit over and generally conform to the top of a user's shoe or boot, generally from toe to arch, the tongue piece having a front end connected in a flexible hinge connection to the footbed, a series of lace eyes at left and right sides of the tongue piece and arranged serially from front to back along each side, and a corresponding series of lace eyes connected to the footbed, a lace at each side of the binding, passing through lace eyes of the tongue piece and lace eyes connected to the footbed generally in alternating relationship, and being connected to the tongue piece and footbed such that when the laces are pulled rearwardly at the back of the binding, at left and right sides, the laces will draw the tongue piece down toward the footbed, firmly engaging the top of the user's boot, wherein the tongue piece comprises a molded flexible component having a hinge extension at the front end serving as the hinge connection to the footbed, the hinge extension extending downwardly and then back to a securement with the footbed, and wherein the molded tongue piece includes a handle loop extending upwardly at its rear, in a position for gripping by a user to pull upwardly on the back of the tongue piece to spread the tongue piece away from the footbed for insertion or removal of a boot.

3. A lace binding for a snowshoe, comprising:

a footbed adapted to be connected to a snowshoe, a tongue piece spaced above the footbed and configured to fit over and generally conform to the top of a user's shoe or boot, generally from toe to arch, the tongue piece having a front end connected in a flexible hinge connection to the footbed, a series of lace eyes at left and right sides of the tongue piece and arranged serially from front to back along each side, and a corresponding series of lace eyes connected to the footbed, a lace at each side of the binding, passing through lace eyes of the tongue piece and lace eyes connected to the footbed generally in alternating relationship, and being connected to the tongue piece and footbed such that when the laces are pulled rearwardly at the back of the binding, at left and right sides, the laces will draw the tongue piece down toward the footbed, firmly engaging the top of the user's boot, and wherein the laces comprise a single lace which crosses from left to right near the front of the tongue piece, and wherein the upper surface of the tongue piece has a plurality of lace-gripping adjustment tabs positioned to engage the lace to adjust the length of usable lacing by taking up varying lengths of the lace thereby accommodating different sizes of user boots.

4. A lace binding for a snowshoe, comprising:

a footbed adapted to be connected to a snowshoe, a tongue piece spaced above the footbed and configured to fit over and generally conform to the top of a user's shoe or boot, generally from toe to arch, the tongue piece having a front end connected in a flexible hinge connection to the footbed, a series of lace eyes at left and right sides of the tongue piece and arranged serially from front to back along each side, and a corresponding series of lace eyes connected to the footbed, a lace at each side of the binding, passing through lace eyes of the tongue piece and lace eyes connected to the footbed generally in alternating relationship, and being connected to the tongue piece and footbed such that when the laces are pulled rearwardly at the back of the binding, at left and right sides, the laces will draw the tongue piece down toward the footbed, firmly engaging the top of the user's boot, and wherein the footbed includes a metal front claw as a base for the footbed, and the front claw including a transverse connecting bracket extending left to right with holes for receiving fasteners securing the bracket to a suspension strap on the snowshoe, and wherein the connecting bracket is angled downwardly from front to back so as to bias the pitch of the binding relative to the snowshoe.

5. A lace binding for a snowshoe in accordance with claim 4, wherein the angle of the connecting bracket relative to the footbed and the bottom of the user's boot is about 5° to 25°.

6. A lace binding for a snowshoe in accordance with claim 5, wherein the angle is about 15°.

7. In a snowshoe binding having a harness for engaging the boot of a user, and having a footbed with a metal cleat forming a base for the footbed, the improvement comprising a connection bracket integrally formed with the metal cleat and extending transversely, the bracket having holes for securing to a suspension strap that extends between the peripheral rails of a snowshoe, and the connection bracket having a bias tilt, angling downward from front to back relative to the general plane of the footbed and of the user's boot when worn by the user, whereby the connection bracket introduces a pitch bias by which the toe end of the binding and of the user's boot is tilted downwardly relative to the snowshoe frame.

8. The apparatus of claim 7, wherein the bias angle of the connecting bracket is about 5° to 25°.

9. The apparatus of claim 7, wherein the bias angle is about 15°.

* * * * *